US010851562B2

(12) United States Patent
Park

(10) Patent No.: US 10,851,562 B2
(45) Date of Patent: Dec. 1, 2020

(54) PASSIVE CONTINUITY MONITORING DEVICE WITH ACTIVE FEATURES

(71) Applicant: The Regents of the University of Colorado, Denver, CO (US)

(72) Inventor: Aaron Park, Boulder, CO (US)

(73) Assignee: The Regents of the University of Colorado, a body corporate, Denver, CO (US)

( * ) Notice: Subject to any disclaimer, the term of this patent is extended or adjusted under 35 U.S.C. 154(b) by 79 days.

(21) Appl. No.: 15/967,429

(22) Filed: Apr. 30, 2018

(65) Prior Publication Data

US 2018/0313111 A1 Nov. 1, 2018

Related U.S. Application Data

(60) Provisional application No. 62/491,870, filed on Apr. 28, 2017.

(51) Int. Cl.

| | |
|---|---|
| ***E05B 45/06*** | (2006.01) |
| ***E05B 15/00*** | (2006.01) |
| ***E05B 47/00*** | (2006.01) |
| ***E05B 45/00*** | (2006.01) |
| *E05B 67/00* | (2006.01) |

(52) U.S. Cl.

CPC ..... *E05B 15/0073* (2013.01); *E05B 45/005* (2013.01); *E05B 45/06* (2013.01); *E05B 47/0038* (2013.01); *E05B 67/006* (2013.01); *E05B 2045/0665* (2013.01)

(58) Field of Classification Search

CPC ..... E05B 15/00; E05B 15/0073; E05B 45/00; E05B 45/005; E05B 45/006; E05B 47/0038; E05B 67/006; E05B 2045/0665; E05B 45/08; E05B 41/00; G09F 3/0329; G09F 3/0352; G07C 9/00896; G07C 2009/0092

USPC ..... 70/413, 30.49, 57.1, 441; 340/542

See application file for complete search history.

(56) References Cited

U.S. PATENT DOCUMENTS

| | | | | | |
|---|---|---|---|---|---|
| 3,993,987 | A * | 11/1976 | Stevens | E05B 45/005 | 340/542 |
| 5,406,263 | A * | 4/1995 | Tuttle | G06K 19/07798 | 340/541 |
| 5,587,702 | A * | 12/1996 | Chadfield | E05B 45/005 | 340/542 |
| 5,727,405 | A * | 3/1998 | Cromwell | E05B 45/005 | 340/427 |
| 6,753,775 | B2 * | 6/2004 | Auerbach | E05B 39/00 | 340/426.16 |
| 6,778,083 | B2 * | 8/2004 | Auerbach | E05B 39/02 | 340/539.1 |

(Continued)

*Primary Examiner* — Suzanne L Barrett

(74) *Attorney, Agent, or Firm* — FisherBroyles LLP; Anthony J DoVale

(57) ABSTRACT

A passive continuity monitoring device is disclosed. This device can be used to protect a lock or other locking device and to indicate when a breach of the lock has occurred. The lock can include a connector with a magnet at one end spaced from an other magnet. The connector can be held in tension when the lock is engaged to maintain the spacing between the magnets. A breach in the loop of the system will cause the magnets to touch and complete a circuit. The completion of the circuit can trigger an alarm, can take a picture of the surrounding area, and can transmit a signal to interested parties.

16 Claims, 2 Drawing Sheets

(56) References Cited

U.S. PATENT DOCUMENTS

| | | | | |
|---|---|---|---|---|
| 7,543,467 | B2 * | 6/2009 | Sheehan | E05B 45/005 340/542 |
| 8,068,027 | B2 * | 11/2011 | Auerbach | G09F 3/0329 340/542 |
| 8,982,360 | B2 * | 3/2015 | Zhao | G08B 13/08 356/614 |
| 9,222,285 | B1 * | 12/2015 | Ilislamloo | E05B 73/0017 |
| 10,641,013 | B2 * | 5/2020 | Yates | G07C 9/00571 |
| 2008/0036596 | A1 * | 2/2008 | Auerbach | E05B 39/00 340/542 |
| 2008/0066502 | A1 * | 3/2008 | Sheehan | E05B 45/005 70/49 |
| 2014/0109631 | A1 * | 4/2014 | Asquith | E05B 45/005 70/15 |

* cited by examiner

PASSIVE CONTINUITY MONITORING DEVICE WITH ACTIVE FEATURES

CROSS-REFERENCE TO RELATED APPLICATIONS

The present application claims the benefit of U.S. Provisional Patent Application No. 62/491,870, filed Apr. 28, 2017.

INCORPORATION BY REFERENCE

The disclosure of U.S. Provisional Patent Application No. 62/491,870, filed Apr. 28, 2017, is hereby incorporated by reference herein for all purposes as if presented in its entirety.

BACKGROUND

Locks for items such as bicycles have been around for several years. Typically, these locks include an operating portion that can be placed around part of a bicycle, such as one wheel and a part of the frame, and then the operating portion interacts with a locking member to secure the lock around the bicycle. However, these types of locks have limited reliability and present little more than a small obstacle to a determined bike thief, who can often quickly cut, break, or otherwise separate the lock from the bicycle. Many a bicycle owner has locked their bicycle and left for a time only to return to discover their bicycle had been taken.

SUMMARY

The present disclosure, in one aspect, provides devices and systems that can detect and signal a user of a system breach, such as when a bicycle is being taken. In one aspect, such a passive continuity monitoring device comprises a pair of magnets positioned substantially adjacent but spaced from one another at some point within a loop that is secured around an item. As shown in the figures, in one aspect, a wire, string, or other substantially flexible elongate connector is connected at each end to one of the magnets. This connector is held in tension within the loop and maintains the distance between the magnets. Additionally, a first conductor is operatively connected to one of the magnets at one end, and a first pole of a power source at the other end. A second conductor is connected to the other magnet and to the electronic hardware. A third conductor is connected to the electronic hardware at one end and to the second pole of the power source at the other end. A breach in the loop of the system causes the connector to break, thus permitting the attraction of the magnets to connect the magnets to one another, which, in turn, completes the circuit, allowing electric current to flow from the power source through the magnets to the electronic hardware. The electronic hardware can comprise an electronic alarm which, when energized alerts the interested parties.

Provided generally herein is a device that detects when an object (or system) is compromised, such as when a lock is cut or punctured. In one aspect, the device then notifies interested parties of the detection. In another aspect, the device uses little or no energy until the breach has occurred.

In one aspect, provided herein is a lock including a lock member capable of being disposed about an item, a lock base, at least a first portion of a connector in the lock member and in the lock base, and the connector includes a first segment and a second segment, and, with the lock member in a locked position around at least a portion of an item, the first segment of the connector is separated from the second segment of the connector by a spacing. Optionally, the lock member can have a flexible shape and can be extendable from and retractable into the lock base. In one aspect, the first segment includes a first magnet and the second segment includes a second magnet, and the first magnet is spaced from the second magnet by the spacing. When the lock is engaged, the connector is in tension to form a loop that maintains the spacing between the first magnet and the second magnet. When a breach in the loop occurs, the connector breaks and permits at least one of the first magnet and the second magnet to move through the spacing to connect the first magnet and the second magnet together to complete a circuit. When the circuit is completed, at least one of the following occurs: an alarm is energized or a signal is transmitted remote from the lock. The alarm can be audible, visual, or physical. The lock can include a power source and a controller, and wherein the connector is non-conductive and draws power from the power source only upon completion of the circuit. The first segment of the connector includes a first anchor point at a first end and the second segment of the connector includes a second anchor point at a second end, and wherein the first anchor point is disposed adjacent the second anchor point when the lock is in the locked position and wherein the first anchor point and the second anchor point allow the lock to detach when the lock is disengaged from the locked position. The first anchor point and the second anchor point can overlap without a gap.

In another aspect, provided herein is a system for passively monitoring security of a lock, the system including a lock member, a lock base, and a connector extending at least partially in the lock member and in the lock base, and the connector includes a first segment and a second segment, and, with the lock member in a locked position around at least a portion of an item, the first segment of the connector is separated from the second segment of the connector by a spacing. Optionally, the lock member can have a flexible shape and can be extendable from and retractable into the lock base. In one aspect, the first segment includes a first magnet and the second segment includes a second magnet, and the first magnet is spaced from the second magnet by the spacing. When the lock is engaged, the connector is in tension to form a loop that maintains the spacing between the first magnet and the second magnet. When a breach in the loop occurs, the connector breaks and permits at least one of the first magnet and the second magnet to move through the spacing to connect the first magnet and the second magnet together to complete a circuit. When the circuit is completed, at least one of the following occurs: an alarm is energized or a signal is transmitted remote from the lock. The alarm can be audible, visual, or physical. The lock can include a power source and a controller, and wherein the connector is nonconductive and draws power from the power source only upon completion of the circuit. The first segment of the connector includes a first anchor point at a first end and the second segment of the connector includes a second anchor point at a second end, and wherein the first anchor point is disposed adjacent the second anchor point when the lock is in the locked position and wherein the first anchor point and the second anchor point allow the lock to detach when the lock is disengaged from the locked position. The first anchor point and the second anchor point can overlap without a gap.

Related methods of operation are also provided. Other apparatuses, methods, systems, features, and advantages of the passive continuity monitoring devices and systems will be or become apparent to one with skill in the art upon examination of the following figures and detailed description. It is intended that all such additional apparatuses, methods, systems, features, and advantages be included within this description, be within the scope of the passive continuity monitoring devices and systems, and be protected by the accompanying claims.

DETAILED DESCRIPTION OF THE INVENTION

Figure 1:
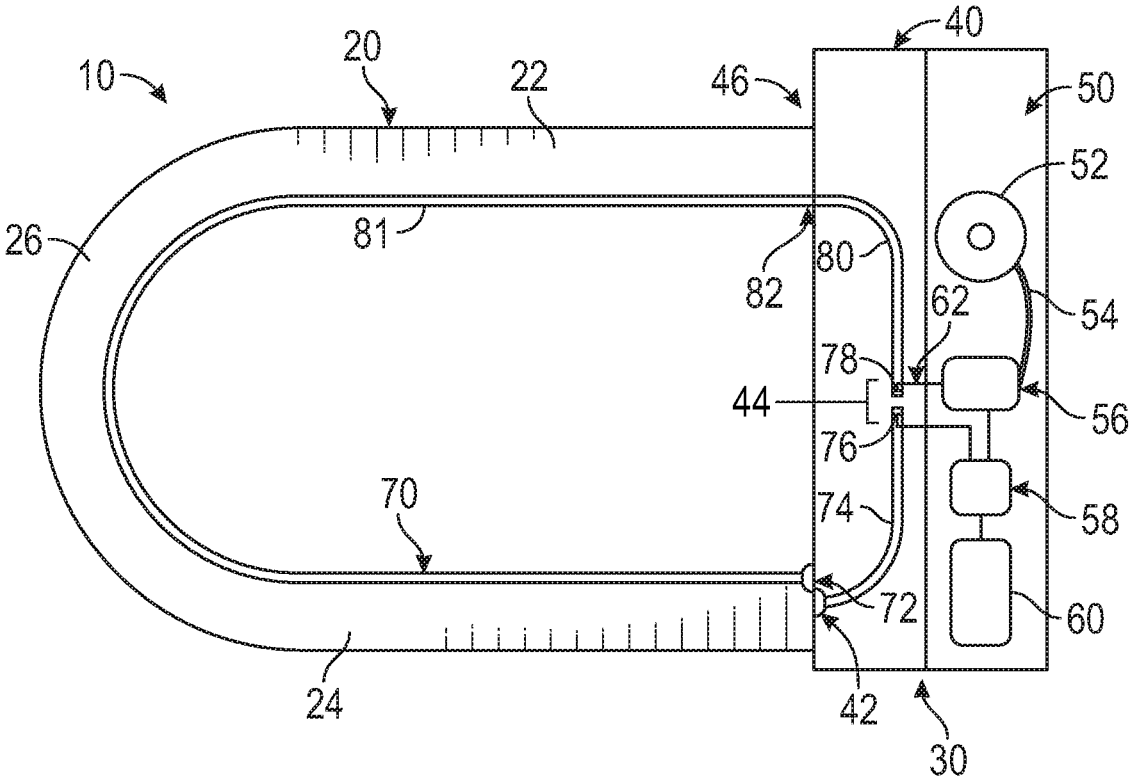
FIG. 1 is a plan view of a passive continuity monitoring lock.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following descriptions provided as illustrative of the principles of the present invention and not in limitation thereof.

As used herein, the singular forms "a," "an", and "the" include plural referents unless the context clearly dictates otherwise. Thus, for example, reference to a "lock" includes aspects having two or more such locks unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Generally described herein is a lock, designated in the figures generally at 10. In one aspect, the lock 10 comprises a body portion and a base portion. The body portion can include a lock component used to secure an item, and the base portion can comprise armed, sensing, and/or notification components that monitor and indicate when a fault condition has occurred, such as the lock being opened or otherwise being separated from the locked position in an unauthorized manner, such as would occur during a theft of the item or break in that typically is locked by a padlock or combination lock, for example. In one exemplary application, the lock 10 could be used for a bicycle, strong box, delivery strong box, safe, ankle bracelet (e.g. for house arrest), combinations with other locks including padlocks, combination locks, etc., and/or could be used in other applications, especially where a lock user will be remote from an item to be locked.

As shown in FIG. 1, the lock 10 includes a tube or housing 20, which can be in any configuration operable to perform the functions as detailed here within. As shown in FIG. 1, housing 20 includes two straight sections 22 and 24 connected by a curved section 26. Generally, the elements of the housing 20 all are sized to receive a portion of an item to be secured, such as part of a frame of a bicycle. The housing 20 can be substantially hollow, substantially solid, or solid and can include additional components there within, such as a wire or other connector 70 as described hereinbelow.

The lock 10 also includes a housing 30 which, as shown in FIG. 1, can comprise multiple components, including a lock base 40 and an electronics housing 50. The lock base 40 can be connected to the housing 20 in multiple orientations and configurations as long as the ability to secure the lock 10 around an item is preserved. Generally, the lock base 40 can be securely attached and detached from the housing 20.

Generally, once the lock base 40 is securely attached to the housing 20, the wire, string, or other substantially flexible elongate connector 70 is arranged in a position to detect a fault condition, such as an unintended breach of the connection. Thus, the arrangement of lock base 40 and housing 20 disposes wire 70 in a secured position with the lock around an item. The wire 70 includes a main portion extending in housing 20 from an anchor point 72 at the end of section 24, along and generally interior of section 24, along and generally interior of section 26, along and generally interior of section 22, to and through a connection point shown at 82, at the end of section 22. A section of wire 70 extends into lock base 40, generally indicated at 80.

As shown in FIG. 1, the lock base 40 includes at least one anchor point 42, which generally aligns with anchor point 72 of wire 70 in section 24 of housing 20. Anchor points 42 and 72 are formed of nonconductive wire so that the lock 10 can be detached. Wire 70 includes a section 74 that extends from anchor point 42 in lock base 40, which anchor point 42 is shown as a nonconductive connection point. The lock base 40 can also house magnets 44 and connector 46 which serves as an interface between tube section 22 in lock base 40 to a first magnet 76, which is spaced from a second magnet 78. Generally, magnets 76 and 78 all are strong magnets that attract one another but which do not contact each other with the lock 10 in the locked position with the wire 70 in the extended position under tension. The wire 70 includes a section 80 that extends between magnet 78 and connection point 82.

FIG. 1 also includes an electronics housing 50. Housing 50 can include an alarm 52, a power source or batteries 56, a microcontroller 58, and a communication device 60. The alarm 52 is shown as an audible speaker, but the housing 50 could additionally or optionally also include a visible alarm, such as a flashing light. As shown in FIG. 1, battery 56 is connected by wiring or other connection device 62 to both magnets 76 and 78 and to microcontroller 58. In turn, the magnet 76 and 78 are also connected to microcontroller 58. The microcontroller 58 is connected to communication device 60, which is connected to alarm 52 at connectors or wiring 54. The battery 56 is shown as a single nine-volt battery, but optionally could either comprise multiple batteries, a rechargeable battery, or could be another power source that would enable the lock 10 to function as detailed here within. The communication device 60 generally is capable of transmitting a signal that the lock had been accessed with the signal being capable of being received remotely from the lock. For example, the signal can be synced to an application on a cellular phone or other wireless receiver, be a Bluetooth signal, be a shortwave, wifi, or radio wave signal, or a dedicated transmitter/receiver combination such as a walkie-talkie or component of the lock that can be separated from the lock and remain with the user. The signal can be received by the user of the lock, such as on an application on the user's phone that can trigger an alarm, text message, phone ringing, or other indicator, can be received by the dedicated receiver synced to the transmitter, or can be received by a remote service or source capable of monitoring whether the lock is breached or the wire 70 is severed or otherwise separated from the locked position in an unauthorized manner.

Generally, the wire 70 forms a loop or similar connection arrangement of a locking device. The magnets 76 and 78 can be positioned substantially adjacent, but spaced from each other, at some point within the loop. In one aspect, the wire 70 can be held in tension within the loop and can maintain the distance between the magnets 76 and 78. Additionally, a first conductor can be operatively connected to one of the magnets 76, 78 at one end and a first pole of a power source at the other end. A second conductor can be connected to the other magnet and to the electronic hardware. A third conductor can be connected to the electronic hardware at one end and to the second pole of the power source at the other end. A breach in the loop of the system will cause the connector to break, thus permitting the magnets 76, 78 to attract and connect to one another, which completes the circuit, and which allows electric current to flow from the power source through the magnets 76, 78, and to the electronic hardware.

In another aspect, the hardware can comprise a camera. Because the lock 10 operates in a low- or no-power mode, the lock 10 is not drawing power. Once powered on, such as by connecting the magnets 76, 78, the communication device 60 can be configured to call or text the cell phone of interested parties to notify them of the breach. The camera, which may or may not be a portion of the cell phone and may or may not be a portion of the electronics housing 50, can also take a picture of the party responsible for the breach. Optionally still, the picture can be stored locally by the electronics hardware or can be transmitted remotely to the cellular phone of the interested party or to a remote monitoring system. The microcontroller 58 is responsible for powering on the cell phone and sounding an audible alarm system in order to draw attention to the breached system.

Figure 2:
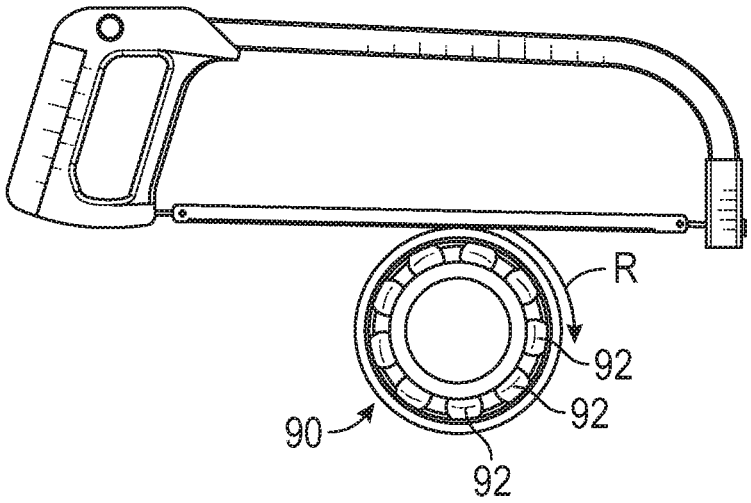
FIG. 2 is a schematic view of a bearing lock that can optionally be used with the lock of FIG. 1.

As can be appreciated, a potential weak point in the device is where the magnets are placed. If the third party were to breach the system between the two magnets, the connector would never be cut and the system would not be energized. As such, a ball bearing or other bearing lock 90 can be placed around the magnets. As shown in FIG. 2, if a perpetrator were to attempt to separate the magnets, such as by cutting or severing through the gap between the magnets with a blade, the blade would first have to pass through the bearings 92. This would be extremely difficult because the bearing would likely spin with the movement of the blade, as shown in direction R. Thus, the inclusion of a bearing lock 90 can prevent a breach between the magnets. Alternatively, the lock could include multiple s of magnet in different locations as redundant systems. In such an alternate embodiment, if two sets of magnets, for example, are included in different locations, if a cut occurs between one set of the magnets, a separate pair of magnets would connect and trigger the alarm.

Figure 3A:
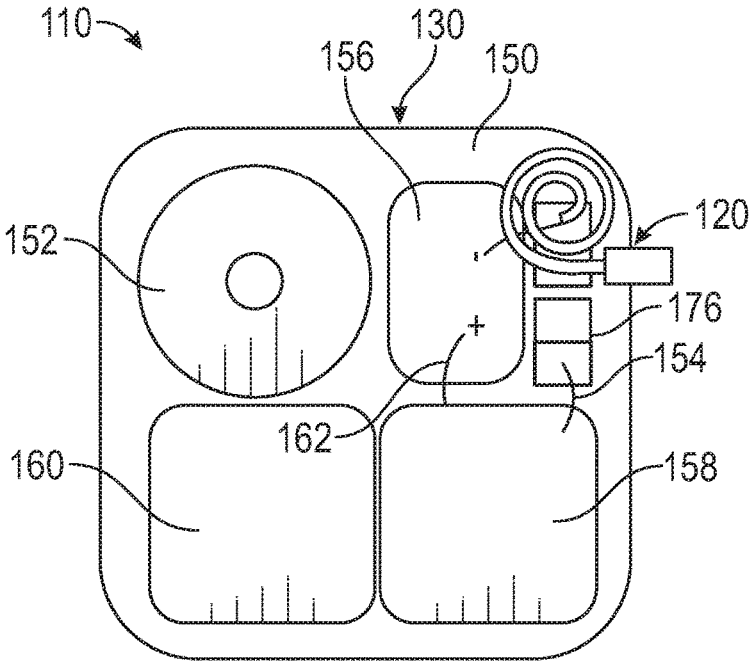
FIG. 3A is an alternative lock design with a retractable wire in a retracted position.
Figure 3B:
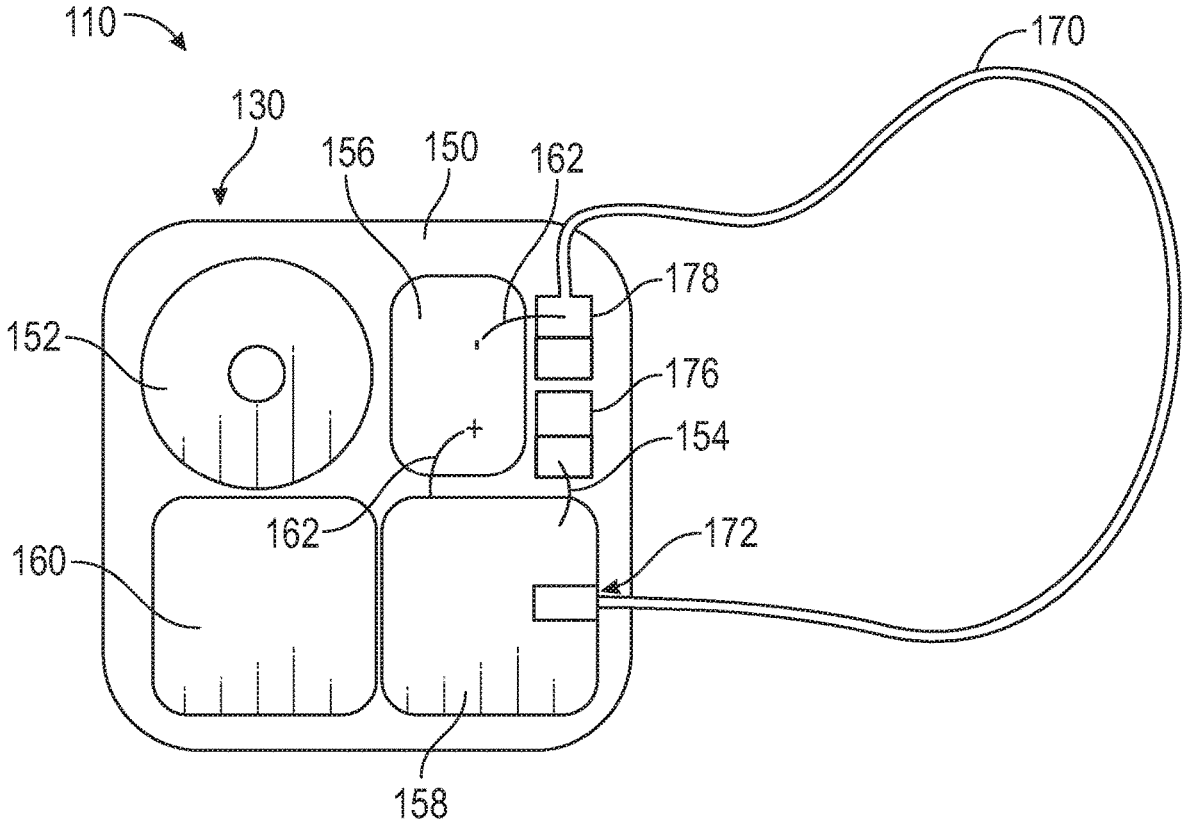
FIG. 3B is the alternative lock of FIG. 3A with the retractable wire in an extended position.

An alternative lock design is shown in FIGS. 3A and 3B, where the locking device 110 includes a retractable wire, string, or other substantially flexible connector 170 that can be elongated from the retracted position shown in FIG. 3A to the extracted position shown in FIG. 3B. Similar features of the lock shown in FIGS. 3A and 3B that are similar to elements of the lock shown in FIG. 1 are designated with similar numbers. As shown in FIGS. 3A and 3B, lock 110 includes a catch 120 and a housing 130. The housing 130, similar to the housing 30 shown in FIG. 1, includes an electronics housing 150 that contains an alarm 152, connectors or wiring 154, a power source 156, microcontroller 158, communication device 160, and connectors or wiring 162. The connectors 154 and 162 connect components into an operational arrangement to allow the microcontroller 158 to detect a breach of the loop, sound the alarm to notify an interested party, such as a user of the lock 110, of the breach via the communication device 160.

In contrast to the fixed design of the lock 10 as shown in FIG. 1, lock 110 includes a retractable wire, string, or other device capable of creating a loop, shown generally at 170. In FIG. 3A, the wire 170 is retractable substantially entirely into the housing 130, with only a part of the catch 120 extending exterior of the housing 130. When the lock 110 is to be used, the catch 120 can be grasped and the wire 170 can be withdrawn from the housing 130. The wire 170 can then be extended or otherwise disposed around an item to be locked. The catch 120 can then be at least partially received into housing 130 at 172 to connect the wire 170, e.g. with microcontroller 158 to connect the loop into a locked position. Similar to the design of FIG. 1, magnets 176 and 178 can be positioned substantially adjacent, but spaced from each other, at some point within the loop. These magnets 176 and 178 operate similar to the arrangement shown above in regard to FIG. 1. Although not shown in the figures, a bearing lock, such as one similar to the one shown in FIG. 2, could be utilized to protect the spacing between the magnets 176 and 178.

One unique aspect of the bike locks shown and described herein is that the locks do not use any power until they are breached and the magnets complete the circuit. This benefit allows the bike locks to operate as intended without maintenance for several years.

In an alternative aspect, the lock(s) detailed herein could be incorporated into a bike rack, which would enable bike riders to use a bike rack lock in lieu of providing their own lock. In another alternative aspect, the lock(s) detailed herein could be incorporated into community application based bikes, such as community application based bike services provided by LimeBike and described at http://www.limebike.com, and could provide theft protection for the smart locks in addition to the conventional functions of starting and stopping a timer to charge customers for bike use time and could use the community application based bike internet connection technology as an avenue to monitor the lock(s).

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A lock comprising:

a lock member capable of being disposed about an item;

a lock base;

at least a first portion of a connector being in the lock member and a second portion of the connector being in the lock base;

wherein the connector includes a first segment and a second segment, and wherein, with the lock member in a locked position around at least a portion of an item, the first segment of the connector is separated from the second segment of the connector by a spacing, wherein the first segment includes a first magnet and the second segment includes a second magnet, and wherein the first magnet is spaced from the second magnet by the spacing, wherein, when the lock is engaged, the connector is in tension to form a loop that maintains the spacing between the first magnet and the second magnet.

2. The lock of claim 1 wherein the lock member extends from the lock base.

3. The lock of claim 1 wherein a breach in the loop breaks the connector and permits at least one of the first magnet and the second magnet to move through the spacing to connect the first magnet and the second magnet together to complete a circuit.

4. The lock of claim 3 wherein, when the circuit is completed, at least one of the following occurs: an alarm is energized or a signal is transmitted remote from the lock.

5. The lock of claim 4 wherein the alarm is audible, visual, or physical.

6. The lock of claim 5 wherein the lock includes a power source and a controller, and wherein the connector is nonconductive and draws power from the power source only upon completion of the circuit.

7. The lock of claim 6 wherein the first segment of the connector includes a first anchor point at a first end and the second segment of the connector includes a second anchor point at a second end, and wherein the first anchor point is disposed adjacent the second anchor point when the lock is in the locked position and wherein the first anchor point and the second anchor point allow the lock to detach when the lock is disengaged from the locked position.

8. The lock of claim 7 wherein the first anchor point and the second anchor point overlap without a gap.

9. A system for passively monitoring security of a lock, the system comprising:

a lock member, a lock base, and a connector extending at least partially in the lock member and in the lock base;

wherein the connector includes a first segment and a second segment, and wherein, with the lock member in a locked position around at least a portion of an item, the first segment of the connector is separated from the second segment of the connector by a spacing, wherein the first segment includes a first magnet and the second segment includes a second magnet, and wherein the first magnet is spaced from the second magnet by the spacing, wherein, when the lock is engaged, the connector is in tension to form a loop that maintains the spacing between the first magnet and the second magnet.

10. The system of claim 9 wherein the lock member extends from the lock base.

11. The system of claim 9 wherein a breach in the loop breaks the connector and permits at least one of the first magnet and the second magnet to move through the spacing to connect the first magnet and the second magnet together to complete a circuit.

12. The system of claim 11 wherein, when the circuit is completed, at least one of the following occurs: an alarm is energized or a signal is transmitted remote from the lock.

13. The system of claim 12 wherein the alarm is audible, visual, or physical.

14. The system of claim 13 wherein the lock includes a power source and a controller, and wherein the connector is nonconductive and draws power from the power source only upon completion of the circuit.

15. The system of claim 14 wherein the first segment of the connector includes a first anchor point at a first end and the second segment of the connector includes a second anchor point at a second end, and wherein the first anchor point is disposed adjacent the second anchor point when the lock is in the locked position and wherein the first anchor point and the second anchor point allow the lock to detach when the lock is disengaged from the locked position.

16. The system of claim 9 wherein the first anchor point and the second anchor point overlap without a gap.

* * * * *